United States Patent [19]

Carriveau

[11] Patent Number: 4,913,024

[45] Date of Patent: Apr. 3, 1990

[54] ELECTRIC GUITAR APPARATUS HAVING MAGNETIC AND CRYSTAL PICKUPS

[76] Inventor: Ronald S. Carriveau, 2029 W. Elm, Phoenix, Ariz. 85015

[21] Appl. No.: 257,339

[22] Filed: Oct. 13, 1988

Related U.S. Application Data

[63] Continuation-in-part of Ser. No. 11,288, Feb. 5, 1987, abandoned.

[51] Int. Cl.[4] ..... G10H 3/18

[52] U.S. Cl. ..... 84/726

[58] Field of Search ..... 84/1.15, 1.16, DIG. 24, 84/267, 291, 1.14

[56] References Cited

U.S. PATENT DOCUMENTS

| | | | |
|---|---|---|---|
| 3,249,677 | 5/1966 | Burns et al. | 84/1.16 |
| 3,454,702 | 7/1969 | Elbrecht et al. | 84/1.15 |
| 4,305,320 | 12/1981 | Peavey | 84/1.16 |
| 4,491,051 | 1/1985 | Barcus | 84/1.14 X |
| 4,501,186 | 2/1985 | Ikuma | 84/1.15 |
| 4,632,002 | 12/1986 | Clevinger | 84/DIG. 24 X |
| 4,843,937 | 7/1989 | Murphy | 84/1.16 |

FOREIGN PATENT DOCUMENTS

| | | | |
|---|---|---|---|
| 2137007 | 9/1984 | United Kingdom | 84/267 |

*Primary Examiner*—Stanley J. Witkowski
*Attorney, Agent, or Firm*—H. Gordon Shields

[57] ABSTRACT

Narrow hollow body guitar includes magnetic and crystal pickups for providing a combination sound from the magnetic and crystal pickups. A crystal pickup is disposed in the bridge beneath the saddle, and one or more magnetic pickups are disposed on the guitar top in conventional locations. Appropriate circuitry is used to blend the input signals from the magnetic and crystal pickups and circuitry is utilized to match the impedance of the magnetic and crystal pickups.

15 Claims, 1 Drawing Sheet

ELECTRIC GUITAR APPARATUS HAVING MAGNETIC AND CRYSTAL PICKUPS

CROSS REFERENCE TO RELATED APPLICATION

This application is a continuation-in-part application of copending application Ser. No. 011,288, filed Feb. 5, 1987, and now abandoned.

BACKGROUND OF THE INVENTION

1. Field of the Invention

This invention relates to electric guitars and, more particularly, to narrow hollow body guitars having magnetic and crystal pickups.

2. Description of the Prior Art

There are generally three types of guitars in standard usage. The first type is the traditional large body acoustic guitar which has been used for many, many years. In acoustic guitars, all of the musical energy from the vibrating strings is utilized to move air. The top, bottom, and sides of the guitar are relatively thin and are relatively flexible so that the resonant chamber beneath the strings vibrates when a note is played on a string of the guitar. When a note is fretted and then unfretted by lifting a fret hand finger, the resonant chamber continues to vibrate even though the string vibration stops.

The acoustic chamber is sensitive to the vibration from strings, and is particularly sensitive to a number of individual notes played in quick succession. The air in the acoustic chamber vibrates in response to the vibration of a new note while it is still vibrating to preceding notes.

The resonant chamber of the large body acoustic guitars is also sensitive to external air-moving devices, such as loud speakers. This results in feedback problems very well known to anyone who tries to amplify acoustic instruments.

A second type of acoustic guitar is the semi-hollow body electric guitar, with F-hole ports or sound holes. The body is narrower than traditional, large body guitars, and the body has much less volume than the traditional large body acoustic guitar. It therefore relies on magnetic pickups to produce sound.

The third type of guitar is the solid body electric guitar, which is typically not concerned with the movement of air or with sound chambers. Rather, solid body electric guitars typically utilize magnetic pickups for sound reproduction from steel strings. The output from pickups is amplified and transmitted through speakers.

U.S. Pat. No. 3,454,702 (Elbrecht et al) discloses electrical circuitry for controlling the tone and for blending the output from electromagnetic and crystal pickups. The '702 patent uses a dual channel amplification system, in which the outputs from the two pickup circuits are connected together in parallel. The patent is not concerned with guitar structure, but merely with the electronics involved in the pickup system utilizing two pickups, an electromagnetic pickup and a crystal pickup.

U.S. Pat. No. 3,769,871 (Cawthorn) discloses a stone guitar with a tuned neck. The body of the guitar is made of stone. The guitar structure is that of a solid body guitar simply made out of stone. Electronic elements involved in the guitar apparatus of the Cawthorn patent are disposed in the stone body.

U.S. Pat. No 4,491,051 (Barcus) discloses a pickup system utilizing a piezoelectric transducer mounted in the bridge of an acoustic guitar or on string adjusters of a solid body guitar. The piezoelectric apparatus, while disposed within the bridge, is also in direct contact with the top plate of the guitar. The pickup thus extends through the bridge. The saddle for the strings is disposed directly on top of the pickup and accordingly extends into the bridge and is virtually free floating on the piezoelectric pickup apparatus.

U.S. Pat. No. 4,501,186 (Ikuma) discloses a particular pickup device for an acoustic guitar. The pickup utilizes both a magnetic pickup disposed in the sound hole of a guitar and piezoelectric pickup detachably attached in the sound hole of the guitar.

UK Patent 2,137,007 A discloses an electric guitar which has a rigid back and side walls and a flexible top plate. A transducer is mounted to the underside of the top plate. The guitar apparatus may be used either as a conventional electric guitar or as an acoustic guitar both with and without electrical amplification.

The inventor herein has developed a narrow hollow body electric guitar without a sound hole or port in which string vibrations are sensed by magnetic pickups and by crystal pickups and the entire sound chamber is used in conjunction with the crystal pickup. The sides and bottom of the sound chamber are relatively thick so that the wood out of which the body of the guitar is made does not vibrate, or vibrates only a minimum amount. Rather, the acoustic energy of the sound chamber is focused in a location adjacent to the crystal pickup. The basic guitar design of the narrow hollow body guitar is described and claimed in copending application Ser. No. 827,520, filed Feb. 10, 1986, which ultimately matured, through a continuation-in-part application, into Pat. No. 4,741,238, issued May 3, 1988, by the inventor herein.

If the acoustic energy of guitars causes the top, bottom and sides of the sound chamber to vibrate, it follows that the sound chamber will also be responsive to vibrations originating outside of the guitar, such as from external moving devices such as loud speakers. The resultant feedback problems are known and understood by those who have tried to amplify acoustic guitars.

The apparatus of the present invention overcomes the problems of the prior art by utilizing a crystal pickup under the saddle on a bridge of a guitar, with the bridge and saddle being disposed at the acoustic center of the sound chamber in a narrow hollow body guitar without sound holes or ports. When combined with the magnetic pickup, the crystal pickup fills in all of the musical tones and harmonics missing in guiters utilizing only magnetic pickups. The combination of crystal pickup and magnetic pickup produces a sound which is referred to as an "eloustic" sound. The eloustic sound makes the standard magnetic pickup electric sound more pleasing to the ear in a musical sense. Moreover, the musical output from the crystal pickup fills in the musical tones and harmonics that are generally not brought out in common electric guitars using only magnetic pickups. Thus, the electric guitar of the present invention provides a relatively complete musical instrument with a subtle combination of electric and acoustic properties that provide a sound different from the sounds produced by guitars of the prior art.

SUMMARY OF THE INVENTION

The invention described and claimed herein comprises a combination of an electric and an acoustic guitar utilizing magnetic and crystal pickups which may be blended together to produce a sound combination having electric and acoustic properties blended together.

Among the objects of the present invention are the following:

To provide new and useful guitar apparatus;

To provide new and useful electric guitar apparatus;

To provide new and useful electric guitar apparatus having acoustic sound properties;

To provide new and useful guitar apparatus having magnetic and crystal pickups;

To provide new and useful apparatus having a plurality of switches and control elements for selectively switching on and off magnetic and crystal pickups and for blending the output from the magnetic and crystal pickups; and To provide new and useful electric and acoustic guitar apparatus for selectively blending outputs from a plurality of pickup elements.

DESCRIPTION OF THE PREFERRED EMBODIMENT

Figure 1:
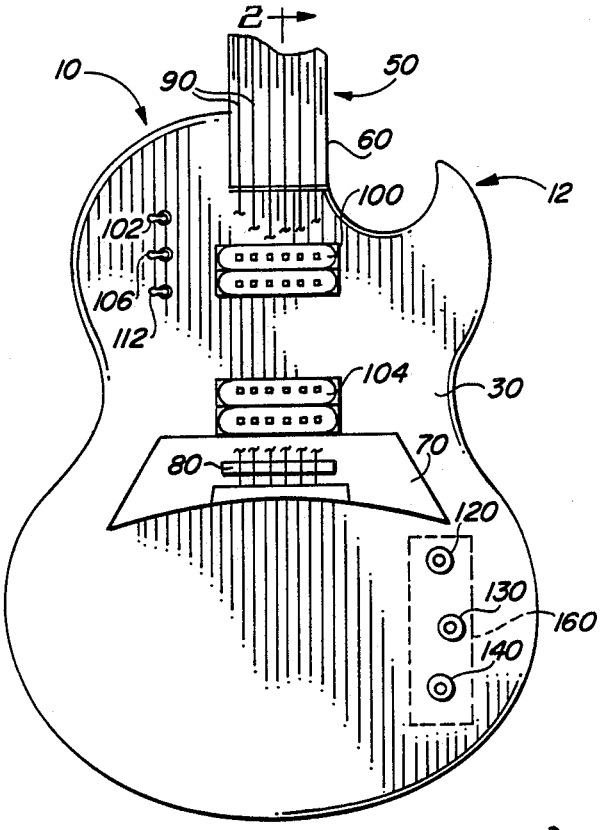
FIG. 1 is a front view of a portion of the guitar embodying the present invention.
Figure 2:
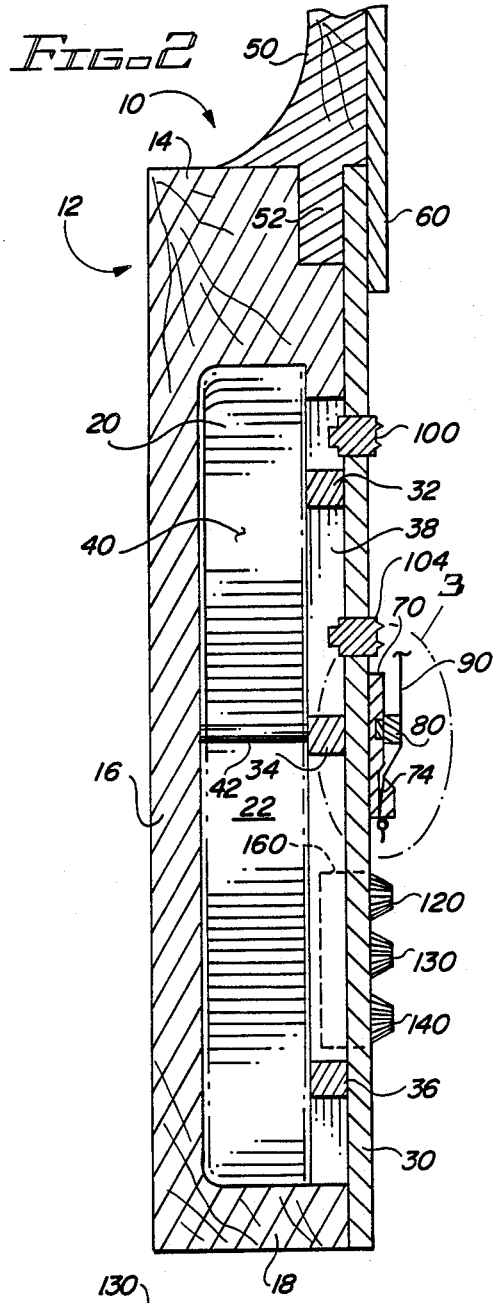
FIG. 2 is a view in partial section taken generally along line 2—2 of FIG. 1.
Figure 3:
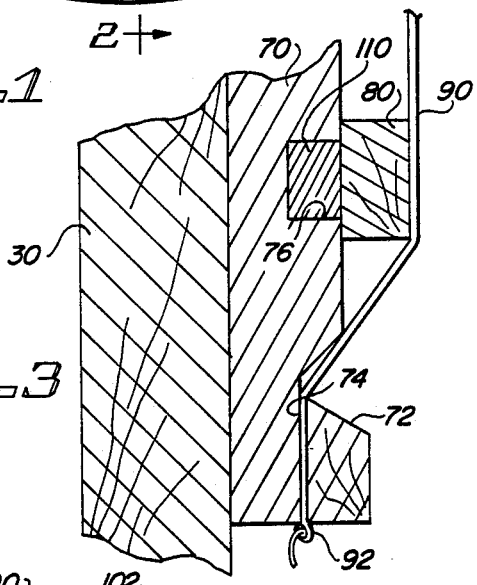
FIG. 3 is an enlarged view in partial section taken from the circle or oval 3 of FIG. 2.

FIG. 1 is a top or front view of guitar apparatus 10 embodying the present invention. FIG. 2 is a view in partial section of guitar apparatus 10 of the present invention taken generally along line 2—2 of FIG. 1. FIG. 3 is an enlarged view in partial section of a portion of the guitar apparatus 10 taken generally from oval 3 of FIG. 2. For the following discussion, reference will be made primarily to FIGS. 1, 2, and 3.

Guitar apparatus 10 includes a body 12 and a neck 50 (see FIG. 2). It wil be noted that only a portion of the neck 50 is shown in FIGS. 1 and 2. The head of the guitar, at the outer end of the neck 50, is not shown.

The top or upper portion of a sound or acoustic or resonant chamber 40 is enclosed by a top panel 30. The top panel 30 is supported over the chamber 40, and between the walls of the body 12, by braces which extend between the side walls and the end walls of the apparatus. Three cross braces are shown in FIG. 2, including a cross brace 32, a cross brace 34, and a cross brace 36. A single longitudinal brace 38 is shown in FIG. 2.

The body 12 is preferably carved from a single block 14 of wood. The body includes a relatively thick bottom 16, a relatively thick lower end wall 18, and a pair of relatively thick side walls, of which a side wall 22 is illustrated in FIG. 2. An upper end wall 20 is also shown in FIG. 2. It will be noted that the thickness of the block 14 at the upper end wall 20 is greater than that of the bottom 16 or of the lower end wall 18, and is also greater than the thickness of the side walls.

The cross braces 32, 34, and 36 extend between, and are appropriately secured to the side walls of the body 12. The longitudinal braces, such as the brace 38, extend between and are appropriately secured to, the end walls, including the lower end wall 18 and the upper end wall 20. A sound post 42 is shown in FIG. 2 disposed with the sound chamber 40 extending between the bottom 16 and the cross brace 34.

The neck 50 includes a tail piece 52 which is disposed in a notch in the block 14 for securing the neck 50 to the body 12. A fret board 60 is in turn secured to the neck 50 and is disposed on the upper portion of the top 30.

On the top 30, and approximately centered over the acoustic chamber 40, is a bridge 70. As best illustrated in FIG. 1, the bridge 70 extends substantially the full distance between the side walls, or the full width of the sound chamber 40. As best shown in FIG. 3, the bridge 70 includes a transverse notch 72 with angularly extending walls. A plurality of apertures, such as an aperture 74, shown in FIGS. 2 and 3, extends through the bottom of the bridge and communicates with the notch 72.

As illustrated in FIG. 1, guitar apparatus 10 is a six-string guitar. Accordingly, six guitar strings 90 are illustrated. In FIG. 3, one of the strings 90 is shown disposed over a saddle 80, which is appropriately secured to the bride 70, and through the aperture 74. The guitar string 90 is secured to the bridge 70 by a knot 92. The knot 92 prevents the string 90 from being pulled through the aperture 74 in the bridge 70. The other end of the string 90 is secured to a tuning head at the outer end of the neck 50.

The bridge 70 also includes a recess 76 in which is disposed the saddle 80. The saddle 80 extends outwardly from the recess 76 and above or outwardly from the bridge 70. A crystal pickup 110 is disposed in the recess 76 beneath the saddle 80. The crystal pickup 110 provides an output in responde to vibration of the saddle 80 and the bridge 70 as the strings 90 are picked or placed by a user. As shown in FIG. 2, the sound post 42 is disposed beneath the saddle 8 and the crystal pickup 110.

On the top 30 of the guitar apparatus 10 are shown two magnetic pickups. The magnetic pickups include a front magnetic pickup 100 and the rear magnetic pickup 104. The magnetic pickups 100 and 104 are mounted in holes extending through the top 30.

Adjacent to the magnetic pickup 100 are three on-off switches. They include a switch 102, a switch 106, and a switch 112. The switches 102, 106, and 112 are also mounted in holes or apertures through the top 30. The switches 102, 106, and 112 are single pole single throw switches for controlling the pickups 100, 104, and 110. The switch 102 is the on-off switch for the front magnetic pickup 100, and the switch 106 is the on-off switch for the rear magnetic pickup 104. The switch 112 is the on-off switch for the crystal pickup 110. It will be noted that the front magnetic pickup 100 is disposed adjacent to the fret board 60, while the rear magnetic pickup 104 is disposed adjacent to the bridge 70. The crystal pickup 110, as discussed above, is disposed beneath the saddle 80 in the recess 76 of the bridge 70.

The magnetic pickups 100 and 104 provide output currents in response to the vibrations of the steel strings 90 as the strings are picked or played by a user of the guitar apparatus 10.

At the lower portion of the body 12 are shown three rotatable control knobs. The knobs for volume and tone and blend control circuitry. A master volume control knob 120 is the uppermost control knob. The knob 120 controls a volume control, and will be referred to simply in conjunction with FIG. 4, below, as volume control 120. The second knob is a master control knob 130. The master tone control knob 130 is connected to a tone control and to tone control circuitry. For purposes of FIG. 4, the knob 130 will be referred to simply as the tone control.

The third knob 140 is a blend control knob which controls the current from the crystal pickup 76 that is blended with, or added to or subtracted from, the current from the magnetic pickups 110 and/or 104.

The control knobs extend through holes or apertures in the top panel 30, as do the switches 102, 106, and 112, discussed above. The knobs are in turn connected to appropriate electrical components, or elements, circuitry, etc., illustrated in block form in FIG. 4. The knobs 120, 130, and 140 are identified in FIG. 4 with their respective electronic components for simplification.

Figure 4:
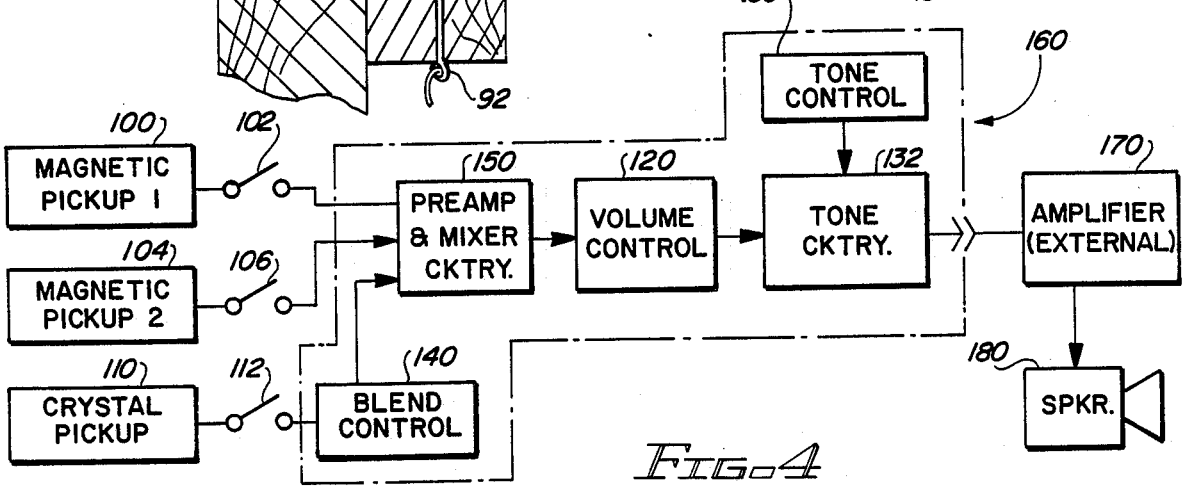
FIG. 4 is a schematic circuit diagram of a portion of the apparatus of the present invention.

FIG. 4 is a schematic circuit diagram illustrating the electronics involved in the guitar apparatus 10 of the present invention. The electronic elements discussed above in conjunction with FIGS. 1, 2, and 3 are schematically illustrated in FIG. 4. The magnetic pickup 100 is shown with its switch 102, the magnetic pickup 104 is shown with its switch 104, and the crystal pickup 110 is shown with its switch 112.

Electrical current from the magnetic pickups 100 and 104 and from the crystal pickup 110 is transmitted to appropriate preamplifier and mixer circuitry denoted in FIG. 4 by a block 150. As indicated above, output from the crystal pickup 112 extends to the preamplifie and mixer circuitry 150 through a blend control circuitry 140. The output current from the three pickups is only transmitted, of course, when the switches 102, 104, or 112 are closed to complete the circuit. With the switches in the open position, on current will flow. It will be noted that the output from the guitar apparatus 12 may include output signals from any one of the pickups, any two of the pickups, or all three of the pickups. Thus, the user of the guitar apparatus 10 may select any desired one or any desired combination of pickups, as desired.

From the preamplifier and mixer circuitry 150, the preamplified current flows through volume control 120. The volume control 120, as discussed above, is the master volume control for the apparatus. Output from the volume control in turn is transmitted to approprite tone circuitry 132. The tone circuitry 132 is controlled from the tone control 130 as discussed above.

The electrical or electronic elements are disposed on a circuit board 160. The circuit board 160 is appropriately secured to the top panel 30. Access to the circuit board and related components is through an access hole in the bottom 16. The access hole, not shown, is covered by a plate. The wires associated with the various electronic elements, etc., are not shown. Similarly, a jack for electrically connecting the various electrical elements to exterior components, as discussed above, is not shown. All such elements are well known and understood in the art.

As with all electric type guitars, output from the guitar itself is transmitted to an external amplifier, such as external amplifier schematically shown as block 170 in FIG. 4. The external amplifier 170 in turn is connected to one or more speakers 180. The musical output from the guitar apparatus 10 eventually emanates from the speaker or speakers 180.

It will be noted that the impedance for the magnetic pickups 100 and 104 is substantially different from the impedance of the crystal pickup 110. Accordingly, the preamplifier and mixer circuit 150 includes appropriate impedance matching circuits so that the impedance of all three pickups is appropriately matched, as well as mixed. Thus, the final output from the speaker or speakers 170 may be either a single magnetic pickup, a single crystal pickup, or a combination of magnetic pickups or a combination of one or two magnetic pickups with the crystal pickups. As will be understood, such combination provides a sound not heretofore obtainable with an electric guitar. It will also be noted that the acoustic chamber 40 is sealed, and that there are accordingly no holes or apertures extending through the top 30 to allow communication between the air within the acoustic chamber 40 and the ambient air outside of the guitar apparatus 10. While various components, such as the magnetic pickups and the switches, are mounted in holes in the top, such holes are not sound ports. The top 30 is substantially "solid" for resonating purposes. Similarly, the covered access hole (not shown) for providing access to the electric components with the chamber 40 is not a sound port.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Electric guitar apparatus including a body, a neck, and strings vibrating in response to being played, comprising, in combination:

wooden body means for defining the body of the guitar apparatus, including a sound chamber defined by relatively thick side and end walls about the sound chamber and a relatively thick bottom to the sound chamber;

a top covering the body means and the sound chamber, the relatively thick side and end walls and the relatively thick bottom and the top substantially preventing vibration of the body means as air within the sound chamber vibrates in response to vibration of the strings;

bridge means secured to the top and disposed over the sound chamber for securing the strings to the top;

means for securing the strings to the bridge means;

a recess in the bridge means beneath the strings;

crystal pickup means disposed in the recess for providing a first output from vibration of the strings;

a saddle secured to the bridge means and disposed over the crystal pickup means for supporting the strings on the bridge means;

magnetic pickup means for providing a second output from the vibration of the strings, secured to the top and over which the strings extend; and circuit means for controlling the outputs from the crystal pickup means and the magnetic pickup means, including first switch means for controlling the output from the magnetic pickup means, second switch means for controlling the output from the crystal pickup means, blend means for blending the output from the crystal pickup means with the output from the magnetic pickup means, and preamplifier means for amplifying the blended outputs from the magnetic pickup means and the crystal pickup means for providing a third output from the electric guitar apparatus which combines the first and second outputs from the crystal pickup means and the magnetic pickup means, respectively.

2. The apparatus of claim 1 in which the bridge means extends across the top covering substantially the distance between the side walls of the sound chamber.

3. The apparatus of claim 1 in which the preamplifier means includes mixer circuitry for mixing the outputs from the magnetic pickup means and from the crystal pickup means and for matching the impedance of the magnetic pickup means and the crystal pickup means.

4. The apparatus of claim 3 in which the magnetic pickup means includes a first magnetic pickup and a second magnetic pickup.

5. The apparatus of claim 4 in which the first switch means includes a first switch for controlling the output from the first magnetic pickup and a second switch for controlling the output from the second magnetic pickup.

6. The apparatus of claim 1 in which the saddle is disposed on the crystal pickup means in the recess and extends outwardly from the bridge means.

7. The apparatus of claim 1 in which the wooden body means further includes a sound post within the sound chamber and disposed beneath the crystal pickup means.

8. The apparatus of claim 1 in which the wooden body means further includes cross braces extending between the side and end walls and the top is secured to the cross braces.

9. The apparatus of claim 8 in which the wooden body means further includes a sound post in the sound chamber extending between the bottom and the cross braces beneath the bridge means.

10. Electric guitar apparatus including a body, a neck, and strings vibrating in response to being played, and having outputs from magnetic and crystal pickups, comprising, in combination;

wooden body means for defining the body of the guitar apparatus, including a sound chamber having relatively thick side walls and end walls about the chamber and a relatively thick bottom to the chamber;

a top covering the body means and the sound chamber, and the relatively thick side walls, the relatively thick end walls, the relatively thick bottom, and the top substantially preventing vibration of the body means as air within the sound chamber vibrates in response to vibration of the strings;

bridge means secured to the top and disposed over the sound chamber for supporting the strings;

means for securing the strings to the bridge means;

crystal pickup means secured to the bridge means for providing a first output in response to vibration of the strings;

a saddle secured to the bridge and disposed over the crystal pickup means for supporting the strings on the bridge means;

a sound post within the sound chamber disposed beneath the crystal pickup means;

magnetic pickup means secured to the top over which the strings extend for providing a second output in response to vibration of the strings; and circuit means for controlling the outputs, including first switch means for controlling the second output, second switch means for controlling the first output, blend means for blending the first output with the second output, and preamplifier means for amplifying the blended first and second outputs for providing an output from the electric guitar apparatus which combines the outputs from the crystal pickup means and the magnetic pickup means.

11. The apparatus of claim 10 in which the preamplifier means includes mixer circuitry for mixing the outputs from the crystal pickup means and from the magnetic pickup means and for matching the impedance of the crystal pickup means and the magnetic pickup means.

12. The apparatus of claim 11 in which the magnetic pickup means includes a first magnetic pickup and a second magnetic pickup, and the second output includes a third output from the first magnetic pickup and a fourth output from the second magnetic pickup.

13. The apparatus of claim 12 in which the first switch means includes a first switch for controlling the output from the first magnetic pickup and a second switch for controlling the output from the second magnetic pickup.

14. The apparatus of claim 11 in which the bridge means includes a recess, and the crystal pickup means is disposed in the recess.

15. The apparatus of claim 14 in which the saddle is disposed in the recess, and the crystal pickup means is disposed in the recess beneath the saddle.

* * * * *